US005781086A

United States Patent [19]

Kato et al.

[11] Patent Number: 5,781,086

[45] Date of Patent: Jul. 14, 1998

[54] NRD GUIDE CIRCUIT, RADAR MODULE AND RADAR APPARATUS

[75] Inventors: Shigeki Kato; Hiroshi Uematsu, both of Saitama-ken; Ken-ichi Ogawa, Wako; Tatsuya Hattori, Saitama-ken, all of Japan

[73] Assignee: Honda Giken Kogyo Kabushiki Kaisha, Tokyo, Japan

[21] Appl. No.: 547,375

[22] Filed: Oct. 24, 1995

[30] Foreign Application Priority Data

Oct. 25, 1994 [JP] Japan ..... 6-260705
Jul. 12, 1995 [JP] Japan ..... 7-176503

[51] Int. Cl.[6] ..... H01P 3/16

[52] U.S. Cl. ..... 333/248; 264/272.11; 333/1.1; 333/24.2

[58] Field of Search ..... 333/1.1, 24.2, 333/239, 248; 29/600; 264/272.11, 272.12, 272.14

[56] References Cited

U.S. PATENT DOCUMENTS

| | | | |
|---|---|---|---|
| 4,463,330 | 7/1984 | Yoneyama | 333/248 X |
| 5,473,296 | 12/1995 | Ishikawa et al. | 333/239 |
| 5,604,469 | 2/1997 | Ishikawa et al. | 333/1.1 |

FOREIGN PATENT DOCUMENTS

| | | |
|---|---|---|
| 58-215804 | 12/1983 | Japan . |
| 63-185101 | 7/1988 | Japan . |
| 62-35281 | 10/1992 | Japan . |
| 7-094915 | 4/1994 | Japan . |
| 6-214008 | 8/1994 | Japan . |
| 0 607 044 | 7/1994 | United Kingdom . |
| 2275826 | 9/1994 | United Kingdom . |

OTHER PUBLICATIONS

Millimeter–Wave Integrated Circuits Using Nonradiative Dielectric Waveguide: Elect. & Comm. in Japan. Part II, Feb. 1994, 2 .

Millimeter–Wave Dielectric Guide Components and Integrated Sub–Systems; R.M. Knox et al; Conference Proc. Military Microwaves 82; London, England; Oct. 1982.

*Primary Examiner*—Paul Gensler
*Attorney, Agent, or Firm*—Lyon & Lyon LLP

[57] ABSTRACT

Dielectric circuit components such as a dielectric strip, dielectric blocks and dielectric ring inserted between conductive plates are molded from a thermoplastic material. As the thermoplastic material, thermoplastic resin is used which has a dielectric constant not greater than 2.4. The dielectric circuit components may be injection-molded from an injection-moldable high polymer material which contains fluorine and has a melting point not greater than 300° C.

3 Claims, 16 Drawing Sheets

ISOLATOR PFA-MADE COMPOSITE PART

ISOLATOR PTFE-PARTS-ASSEMBLED PRODUCT

NRD GUIDE CIRCUIT, RADAR MODULE AND RADAR APPARATUS

BACKGROUND OF THE INVENTION

1. Field of the Invention

The present invention relates to a nonradiative dielectric waveguide (hereinafter "NRD" guide) circuit, and a radar module and a radar apparatus which uses an NRD guide circuit.

2. Description of the Related Art

An NRD guide comprising dielectric strips inserted between parallel, opposed conductive plates and an NRD guide circuit using such an NRD guide are known from publications such as Japanese Patent Publication No. SHO 62-35281 and Japanese Patent Laid-Open Publication Nos. SHO 58-215804 (U.S. Pat. No. 4,463,330), SHO 63-185101 and HEI 7-94915.

FIGS. 15A and 15B illustrate the structure of an FM radar module employing an NRD guide circuit which is disclosed in Japanese Patent Laid-Open Publication No. HEI 6-214008 (U.S. Pat. No. 5,640,700), originating from a patent application filed by the same assignee as the present application, and FIG. 16 is an exploded perspective view showing the structure of a conventionally-known NRD guide isolator.

In FIGS. 15A and 15B, there is shown the structure of an FM radar module as one typical application of the NRD guide circuit. In the FM radar module 80, various kinds of circuit component parts, such as an FM signal generator 83, an NRD guide isolator 84, a mixer circuit 85 and an antenna block 86, are disposed in respective predetermined positions between a pair of parallel, opposed upper and lower conductive plates 81, 82. Reference numeral 87 denotes a horn of a transmitter-receiver antenna.

As shown in FIG. 16, the conventionally-known NRD guide isolator 84 comprises an assembly of plural parts 91 to 98 as will be described hereinbelow. Reference numeral 91 denotes a dielectric strip constituting an input line, reference numeral 92 denotes dielectric blocks constituting a mode suppressor, and reference numeral 93 denotes a dielectric ring constituting the central member of the isolator 84. Further, reference numeral 94 denotes a dielectric strip constituting an output line, reference numeral 95 a dielectric strip constituting a linear line of a non-reflective terminal circuit, reference numeral 96 a wave absorber constituting the non-reflective terminal circuit, reference numeral 97 a substrate provided with a filtering conductor for the mode suppressor, and reference numeral 98 ferrite discs disposed on the upper and lower sides of the dielectric ring 93. Each of the dielectric circuit parts such as the dielectric strips, dielectric blocks and dielectric ring is made by cutting PTFE (polytetrafluoroethylene) resin belonging to fluororesin which presents good high-frequency properties.

Japanese Patent Laid-open Publication No. SHO 63-185101 describes a mode suppressor which comprises an integrally-formed structure of a polystyrene dielectric block and a filtering metal plate for the mode suppressor.

However, the PTFE resin is not suitable for injection molding due to its high melt viscosity, and hence the dielectric circuit parts such as the dielectric strips, dielectric blocks and dielectric ring have to be made by a cutting process, requiring a great number of man-hours.

Further, as seen from FIGS. 15 and 16, in order to construct a functional module for a radar or the like by use of an NRD guide circuit, a large number of discrete parts must be accurately positioned and secured to the conductive plates such as by adhesive bonding against their accidental positional shifts, thus requiring a large number of man-hours to assemble the parts.

Since a plurality of discrete parts are assembled as noted above, positional shifts of the parts or inter-part gaps would occur from temperature changes due to different thermal expansion and shrinkage rates of the parts, resulting in unwanted changes in the electric characteristics of the module. In particular, in the case where the dielectric parts made by cutting are employed, stress applied to the parts during the cutting process would be removed by temperature impact to create inter-part gaps. To guarantee a long-lasting reliability of the module, extra steps had to be taken to previously apply temperature impact to each part in advance etc., for stabilization of the parts' shapes.

SUMMARY OF THE INVENTION

A first object of the present invention is to facilitate production of dielectric circuit component parts such as a dielectric strip, dielectric blocks and dielectric ring.

A second object of the invention is to integrate a plurality of dielectric circuit component parts so as to minimize the number of parts to be assembled, to thereby permit easier assemblage of the parts.

It is a third object of the invention to provide an NRD guide circuit having characteristics which have reduced mechanical vibration and temperature change, and a radar module and a radar apparatus which use such an NRD guide circuit.

According to the NRD guide circuit of the present invention as described above, because the dielectric circuit component parts employed are molded from thermoplastic resin, the dielectric circuit component parts can be mass-produced with improved efficiency. Further, because no stress has been applied to the dielectric circuit component parts by a cutting process etc., stabilized characteristics of the dielectric circuit component parts are ensured. Where a material of relatively great dielectric constant is used, the line width of the dielectric circuit component parts must, as a rule, be designed to be narrow and hence the molding efficiency could be lowered; however, by use of a material having a dielectric constant not greater than 2.4, the component parts can be easily made into sizes suitable for mass-production. Further, by use of a fluorine-containing high polymer material, dielectric circuit component parts of high heat resistance can be obtained which, in the millimeter wave zone, presents a small loss tangent (tan $\delta$) and small propagation loss in high-frequency signals. Moreover, the use of an injection-moldable fluoro high polymer material having a melting point not greater than 300° C. can substantially facilitate the injection molding.

According to the NRD guide circuit of the present invention, the number of component parts to be assembled can be substantially reduced because a plurality of dielectric circuit component parts are integrated. Thus, the NRD guide circuit can be assembled with increased efficiency, and gaps or positional shifts between the parts will occur in fewer places. This can highly enhance the reliability of the NRD guide circuit and a functional module employing such an NRD guide circuit. Further, the use of injection molding allows complex-shaped component parts to be made with ease, and the use of a fluorine-containing high polymer material as a molding material can achieve a dielectric circuit composite part which has a high heat resistance and presents a small loss tangent (tan $\delta$) and small propagation loss in high-frequency signals.

Further, with the NRD guide circuit of the present invention, plural dielectric circuit component parts are integrated into a single composite part so as to be used in common for two or more circuits. Thus, the composite part can be used universally for multiple purposes. Furthermore, in the NRD guide circuit of the present invention, the central ring portion and rod portions extending radially from the ring portion are integrally formed by injection molding so that the composite part may be suitably used in both an NRD guide circulator and NRD guide isolator. Thus, by use of such an NRD guide circuit, the circulator and isolator can be assembled with utmost ease.

BRIEF DESCRIPTION OF THE DRAWINGS

Preferred embodiments of the present invention will be described in greater detail hereinbelow with reference to the accompanying drawings, in which.

DETAILED DESCRIPTION OF THE PREFERRED EMBODIMENTS

Figure 1:
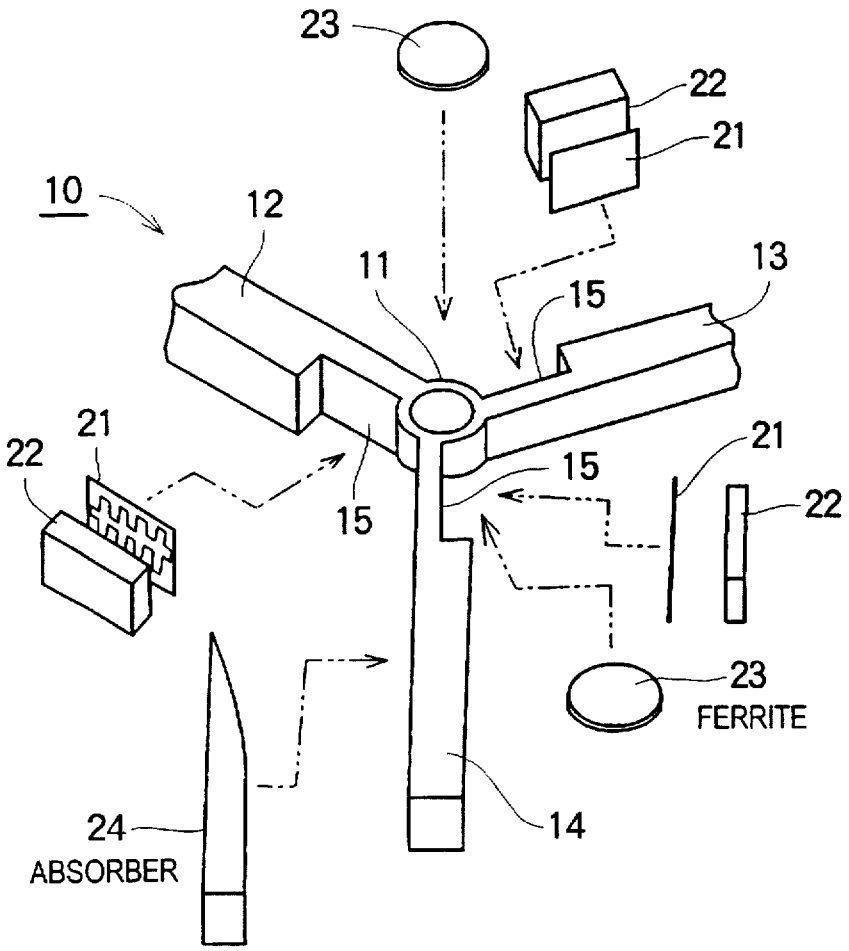
FIG. 1 is an exploded perspective view of various parts of an NRD guide circuit according to one embodiment of the present invention.

FIG. 1 is an exploded perspective view showing an example of a composite part 10 employed in an NRD guide circuit according to one embodiment of the present invention. This composite part 10 is intended for use in an NRD guide isolator and an NRD guide circulator, and includes an input line portion 12 , an output line portion 13 and a terminal line portion 14 extending radially from a central ring portion 11, and one-side recessed portions 15 of a mode suppressor. These portions are integrally formed by injection molding so as to minimize the number of parts to be assembled.

In each one-side recessed portion 15 of the mode suppressor are mounted a substrate 21 having a filtering conductive pattern formed thereon and a dielectric block 22 with the substrate 21 interposed between the block 22 and surface of the recessed portion 15. Further, ferrite disks 23 are disposed on the upper and lower sides of the central ring portion 11. An NRD guide circulator can be constructed by arranging these parts in the above-mentioned manner, while an NRD isolator can be constructed by additionally providing a wave absorber 24 along the length of the terminal line portion 14.

It should be noted that the number of component parts to be assembled may be reduced further by integrally forming the substrate 21 bearing the filtering conductive pattern and the heat-resisting ferrite discs 23 by insert molding.

In this embodiment, the composite part 10 is molded from a PFA (tetrafluoroethylene-perfluoroalkylvinylether copolymer) material. The gate of the molding mold is designed to have a greater wall thickness than normal so as to establish a higher injection pressure, in order to prevent sinkage in the composite part 10.

Some of various molding materials of small dielectric constant have a molecular structure consisting of carbon and hydrogen alone, but such materials are, due to their low heat resisting property, not suitable for making component parts of, for example, vehicle-mounted radars which are used over a wide temperature range. Thus, it is preferable to use a fluorine-containing high polymer material of small loss tangent (tan $\delta$) for injection molding, so that such a composite part 10 is obtained which can effectively reduce the propagation loss of electric wave and can operate properly over a wide temperature range.

It should be obvious that by use of a high-molecular fluorine material which presents a dielectric constant not greater than 2.4 in the millimeter wave zone (30 to 300 GHz) and is suitable for injection molding, each of the composite part 10 and other dielectric circuit component parts can be formed with increased ease. In the case where a molding material of great dielectric constant is used, however, the dielectric circuit component parts must be designed to have a narrow line width, which could degrade the moldability of the parts, thus making it difficult to achieve a sufficient processing accuracy.

Figure 2A:
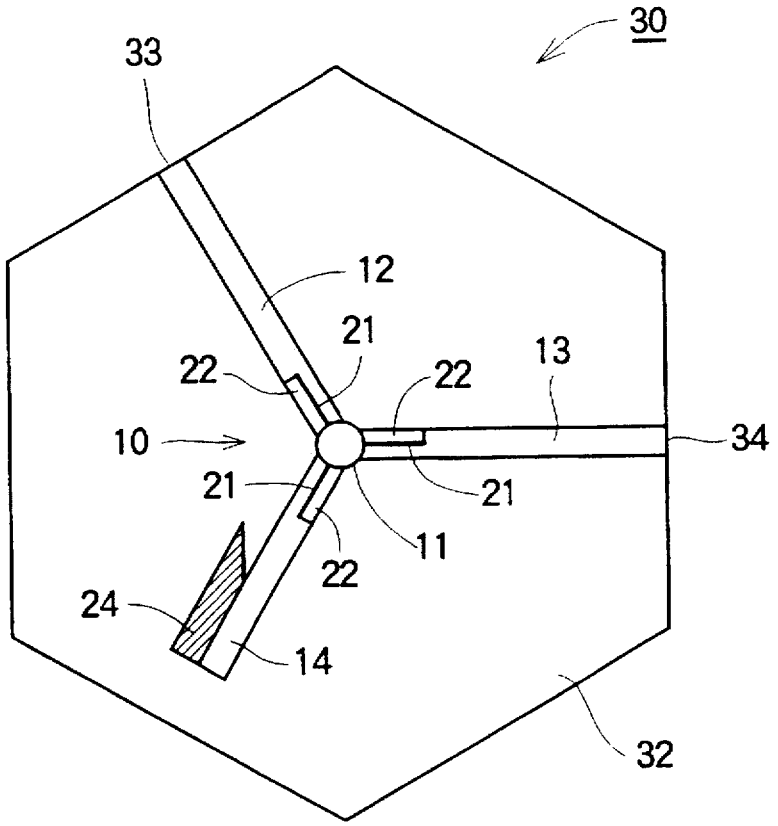
FIG. 2A is a plan view of an NRD guide isolator of the present invention.
Figure 2B:
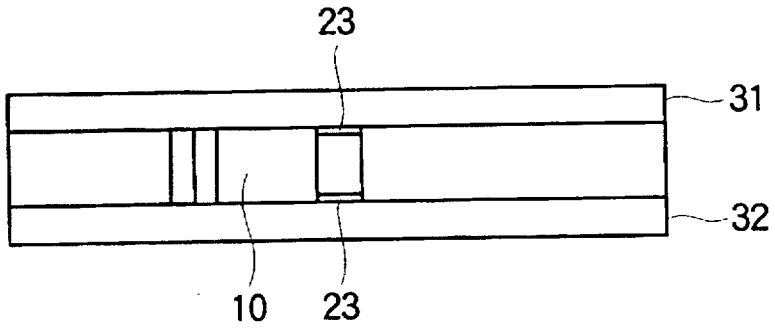
FIG. 2B is a side view of the NRD guide isolator of FIG. 2A.

FIGS. 2A and 2B show the structure of the NRD guide isolator employing the NRD circuit of FIG. 1. In this isolator 30, the component parts 10 and 21 to 24 of FIG. 1 are disposed in respective predetermined positions between a pair of parallel, opposed upper and lower conductive plates 31 and 32. Reference numeral 33 denotes an input section for a high-frequency signal, and reference numeral 34 denotes an output section for a high-frequency signal. The NRD guide isolator 30 is intended for efficiently transmitting a high-frequency signal supplied through the input section 33 to the output section 34 and preventing a high-frequency signal from being transmitted from the output section 34 to the input section 33.

Figure 3:
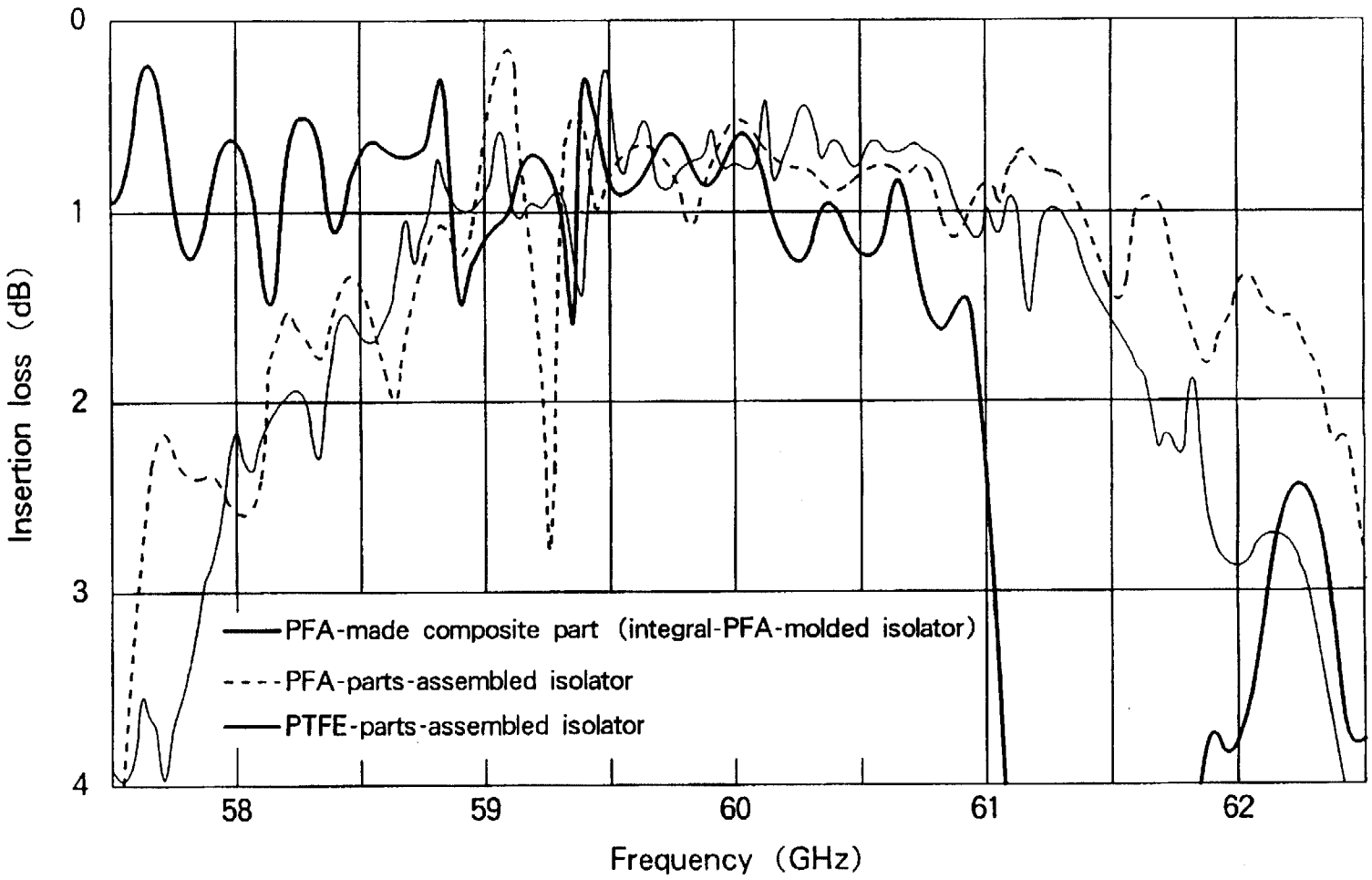
FIG. 3 is a graph showing frequency-insertion loss characteristics of different types of NRD guide isolators.

FIG. 3 is a graph showing frequency-insertion loss characteristics of different types of NRD guide isolators, in which the horizontal axis represents frequency in GHz and the vertical axis represents insertion loss in dB (i.e., loss caused in input signal passing from the input section 33 to the output section 34). In the graph of FIG. 3, the heavy solid line denotes an insertion loss curve of an NRD guide isolator employing the composite part 10 of FIG. 1 integrally molded from a PFA material (hereinafter "integral-PFA-molded isolator"); the light solid line denotes an insertion loss curve of a conventional NRD guide isolator made by cutting PTFE resin to form individual component parts as shown in FIG. 2 and then assembling the thus-formed component parts (hereinafter "PTFE-parts-assembled isolator"); and the broken line denotes an insertion loss curve of an NRD guide isolator injection-molded from a PFA material to form individual component parts and then assembling the thus-formed component parts (hereinafter referred to as "PFA-parts-assembled isolator"). A trial product of the integral-PFA-molded isolator presents an increased insertion loss in the frequency region of 60 to 61 GHz but presents an insertion loss not greater than two decibels in the frequency region of 57.5 to 60-GHz, from which it is seen that this product has a frequency-insertion loss characteristic equivalent to or better than that of the conventional PTFE-parts-assembled isolator. It will also be seen from the graph that the PFA-parts-assembled isolator has a frequency-insertion loss characteristic substantially equivalent to that of the conventional PTFE-parts-assembled isolator.

Figure 4:
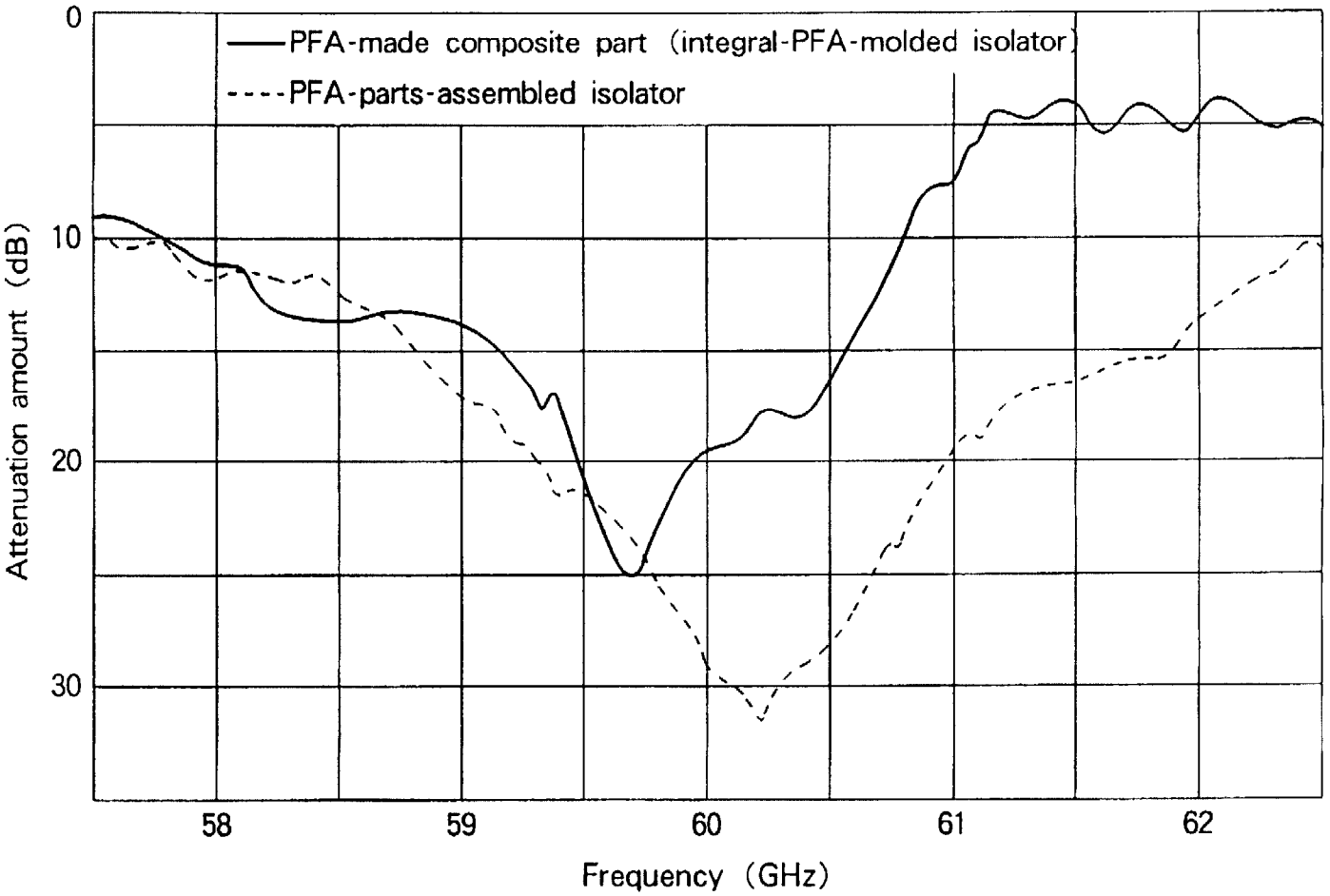
FIG. 4 is a graph showing frequency-attenuation characteristics of different types of NRD guide isolators.

FIG. 4 is a graph showing frequency-attenuation characteristics of different types of NRD guide isolators, in which the horizontal axis represents frequency in GHz and the vertical axis represents attenuation amount in dB (i.e., loss caused in input signal passing from the output section 34 to the input section 33). In the graph of FIG. 4, the heavy solid line denotes an attenuation amount curve of the integral-PFA-molded isolator employing the composite part 10 of FIG. 1, and the broken line denotes an attenuation amount curve of the PFA-parts-assembled isolator. With the trial product of the integral-PFA-molded isolator, a reduced isolation characteristic is presented in the frequency region higher than 60 GHz, but the frequency bandwidth where the attenuation amount exceeds 15 dB covers more than 1 GHz. The graph shows that the integral-PFA-molded isolator is suitable for use in an FM radar module, etc.

Figure 5:
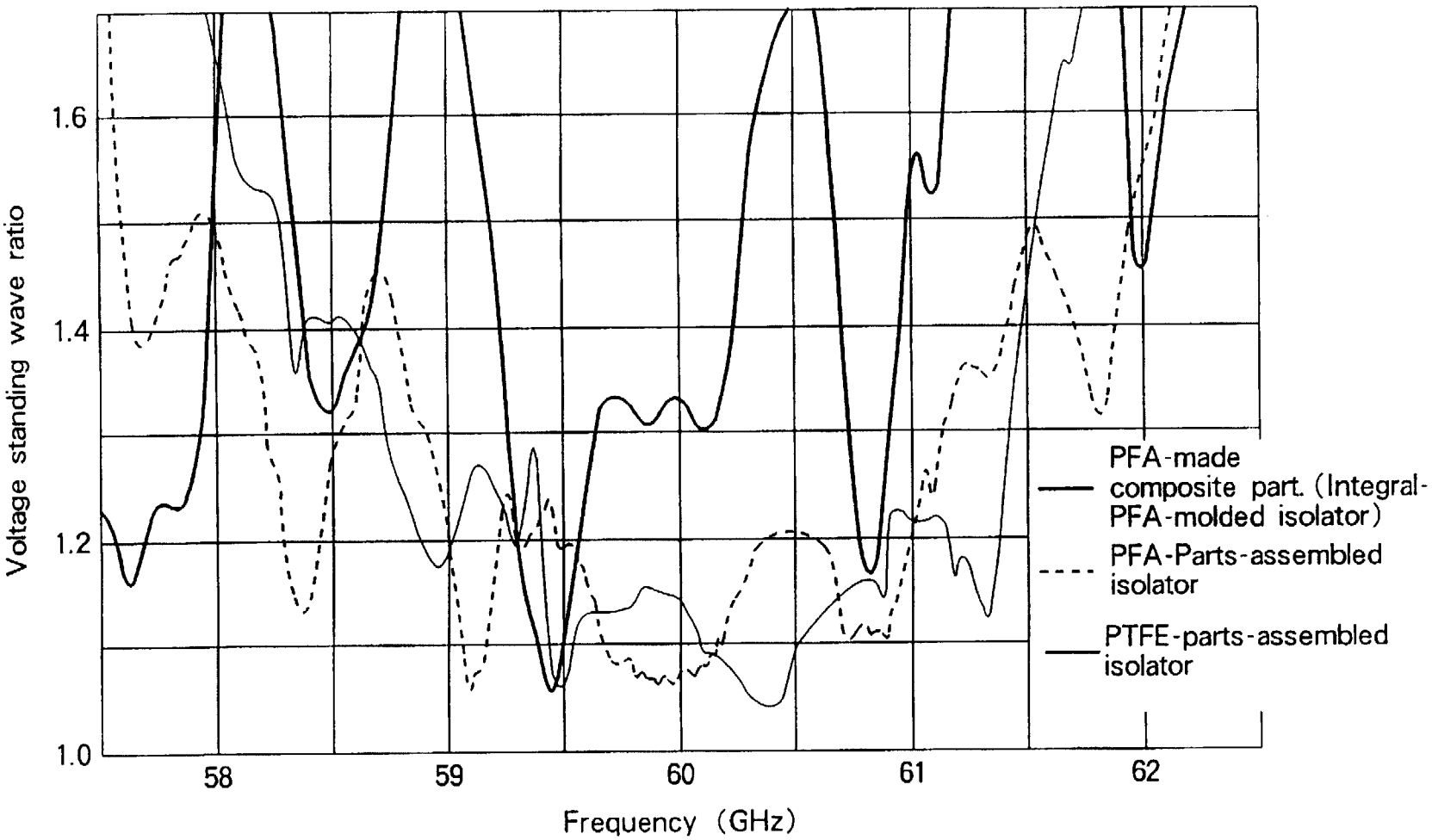
FIG. 5 is a graph showing frequency-voltage standing wave ratio characteristics of different types of NRD guide isolators.

FIG. 5 is a graph showing frequency-voltage standing wave ratio characteristics of different types of NRD guide isolators, in which the horizontal axis represents frequency in GHz and the vertical axis represents voltage standing wave ratio. The measurement of the voltage standing wave ratio was carried out with a rod antenna connected to the output section 34 (see FIG. 2A). In FIG. 5, the heavy solid line denotes a voltage standing wave ratio curve of the integral-PFA-molded isolator employing the composite part 10 of FIG. 1; the broken line denotes a voltage standing wave ratio curve of the PFA-parts-assembled isolator; and the light solid line denotes a voltage standing wave ratio curve of the conventional PTFE-parts-assembled isolator. The graph apparently shows that the integral-PFA-molded isolator employing the composite part 10 is suitable for use in an FM radar etc., although, relative to the conventional PTFE-parts-assembled and PFA-parts-assembled isolators, the isolator presents greater changes in the voltage standing wave ratio and a narrower frequency band where the voltage standing wave ratio is below a predetermined value (e.g., 1.4).

Figure 6:
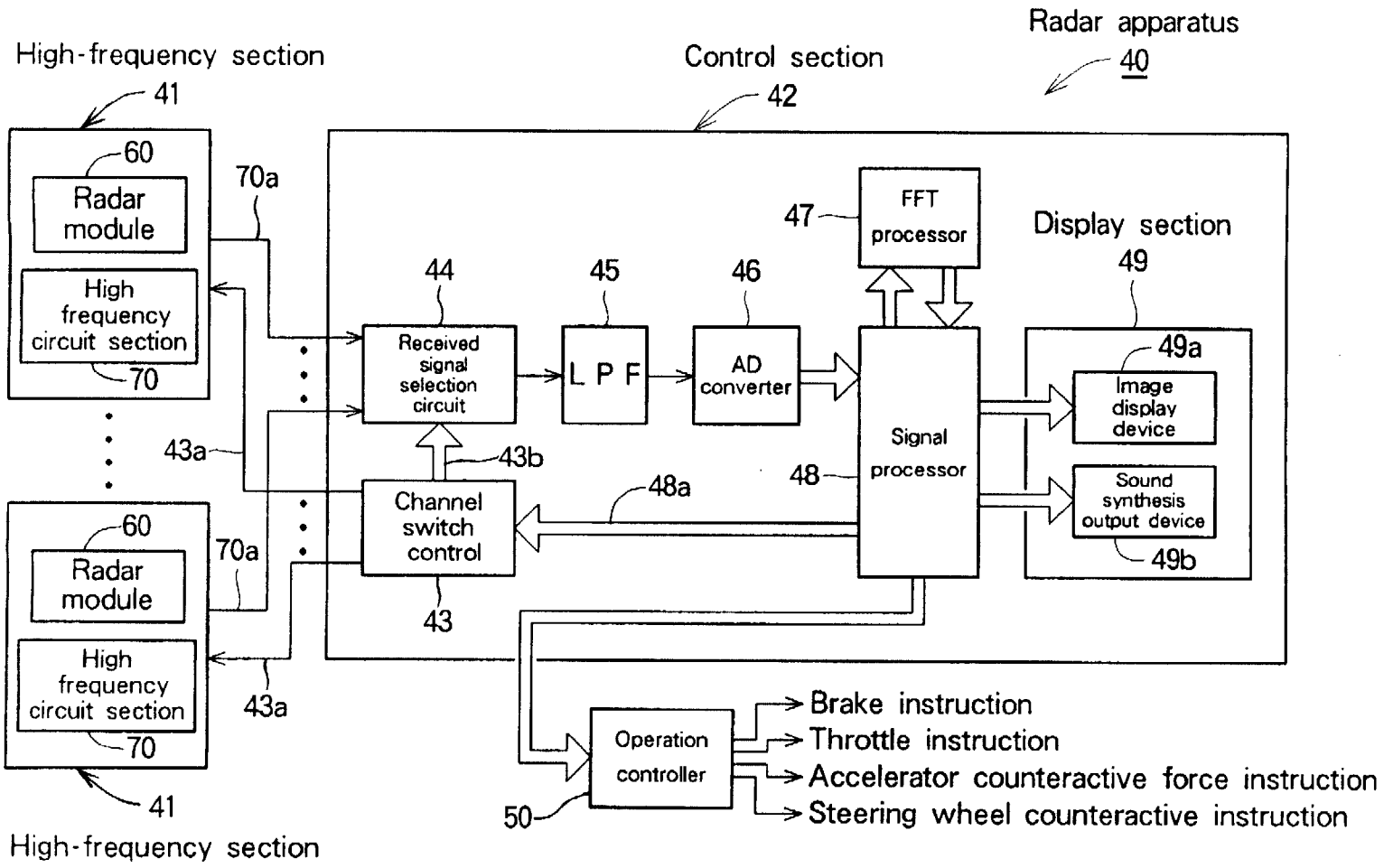
FIG. 6 is a block diagram illustrating the general structure of a radar apparatus of the present invention.

Next, a description will be made about examples of a radar module and a radar apparatus constructed by use of the dielectric circuit component parts injection-molded from a fluorine-containing high polymer material. FIG. 6 is a block diagram illustrating the general structure of the radar apparatus in accordance with an embodiment of the present invention. The radar apparatus 40 of FIG. 6 comprises a plurality of high-frequency sections 41 and a control section 42. Each of the high-frequency sections 41 includes a radar module 60 provided with the above-mentioned NRD guide circuit, and a high-frequency circuit section 70. The high-frequency sections 41 different in detection directivity are positioned around a vehicle or car so that detection can be made of any possible obstacle over a wide range by selective use of any of the sections 41.

The control section 42 comprises a channel-switching controller 43 for controlling the switching or change-over of a high-frequency section 41 to be used for transmitting and receiving a signal, a received signal selection circuit 44 for selectively switching a received signal (beat signal), a low-pass filter (LPF) 45 which constitutes an anti-alias filter, an A/D converter 46 for converting into digital form a beat signal from which high frequency components have been removed by the low-pass filter (LPF) 45, an FFT (Fast Fourier Transform) processor 47 for conducting a frequency spectrum analysis of the A/D-converted beat signal by applying a Fast Fourier Transform to the beat signal, a signal processor 48 for controlling the overall operation of the radar apparatus 40, and a display section 49. Preferably, in this embodiment, the FFT processor 47 is implemented by a digital signal processor (DSP), and the signal processor 48 is implemented by a microcomputer.

The channel-switching controller 43 supplies a transmission instructing signal **43*a* to any of the high-frequency sections 41 designated on the basis of a transmitting/receiving channel designating signal 48*a* output from the signal processor 48. The channel-switching controller 43 also supplies a receiving channel designating signal 43*b* to the received signal selection circuit 44 so that the selection circuit 44 passes the beat signal (received signal) from the designated high-frequency sections 41 to the low-pass filter (LPF) 45**.

The signal processor 48 determines a distance to an obstacle on the basis of the frequency spectrum data of the beat signal output from the FFT processor 47, and also renewably stores the determined distance in correspondence to the detection directivity. On the basis of the determined distance, the signal processor 48 generates image information representative of the presence of and distance to the obstacle on the basis of the determined distance data. The image information thus generated is supplied to an image display device **49*a* within the display section 49, where it is displayed in visual form. Further, the signal processor 48 causes a sound synthesis output device 49*b*** to announce in sound the presence of an obstacle and also the direction of and distance to the obstacle.

On the basis of the detected situations surrounding the vehicle detected by the radar, the signal processor 48 is capable of automatically controlling the operation of the vehicle via an operation controller 50, and applying appropriate counteractive force to the vehicle operator's accelerating and steering actions so as to help operation of the vehicle. For example, when a distance to another vehicle running ahead of the vehicle has become shorter than a predetermined reference value, a braking instruction may be given, or when there exists some obstacle to the forward-left of the vehicle, counteractive force may be applied to the counterclockwise steering operation so that the steering wheel feels heavy enough to warn the vehicle operator of the presence of the obstacle. Further, when the vehicle is in a cruising mode on an express highway etc., a throttling instruction may be output in the light of not only a distance to another vehicle running ahead but also situations obliquely forward of the vehicle of interest, so as to automatically adjust the vehicle velocity.

Figure 7A:
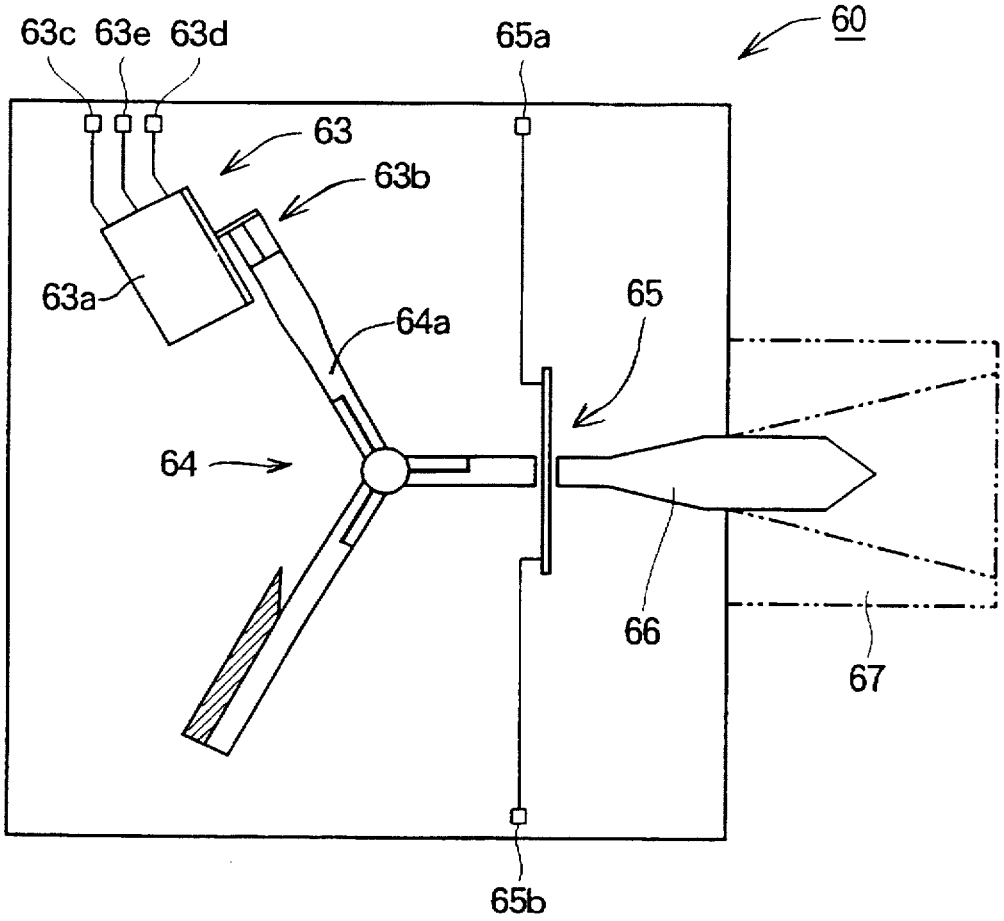
FIGS. 7A and 7B are plan and side views, respectively, illustrating the structure of a radar module of the present invention.
Figure 7B:
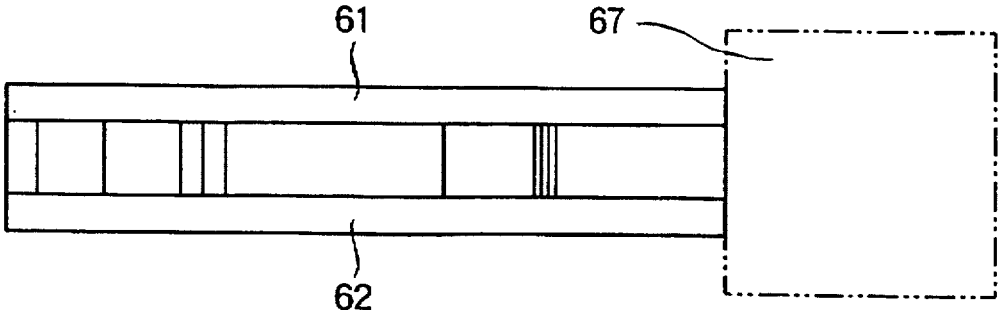

FIGS. 7A and 7B are plan and side views, respectively, illustrating the structure of the radar module in accordance with an embodiment of the present invention. In this radar module 60, a high-frequency signal generator 63, an NRD guide isolator 64, a mixer circuit 65 and a dielectric rod antenna 66 are disposed in respective predetermined positions between a pair of parallel, opposed upper and lower conductive plates 61 and 62. Reference numeral 67 denotes an antenna horn.

The high-frequency signal generator 63 includes a voltage-controlled oscillator 63*a* provided with a Gunn oscillator etc., and a signal supply section 63*b* for supplying a high-frequency (e.g., 60 GHz±several hundred MHz) signal generated by the oscillator 63*a* to an input line portion 64*a* of an NRD guide isolator 64. Reference numerals 63*c* and 63*d* denote positive and negative power source terminals of the voltage-controlled oscillator 63*a*, and reference numeral 63*e* denotes an input terminal for an oscillation-frequency designating voltage signal.

The NRD guide isolator 64 has the same structure as the one shown in FIGS. 1 and 2. The mixer circuit 65 is provided with a Schottky barrier diode (SBD) as a mixer element. Reference numerals 65*a* and 65*b* denote terminals for supplying bias current to the Schottky barrier diode.

Figure 8:
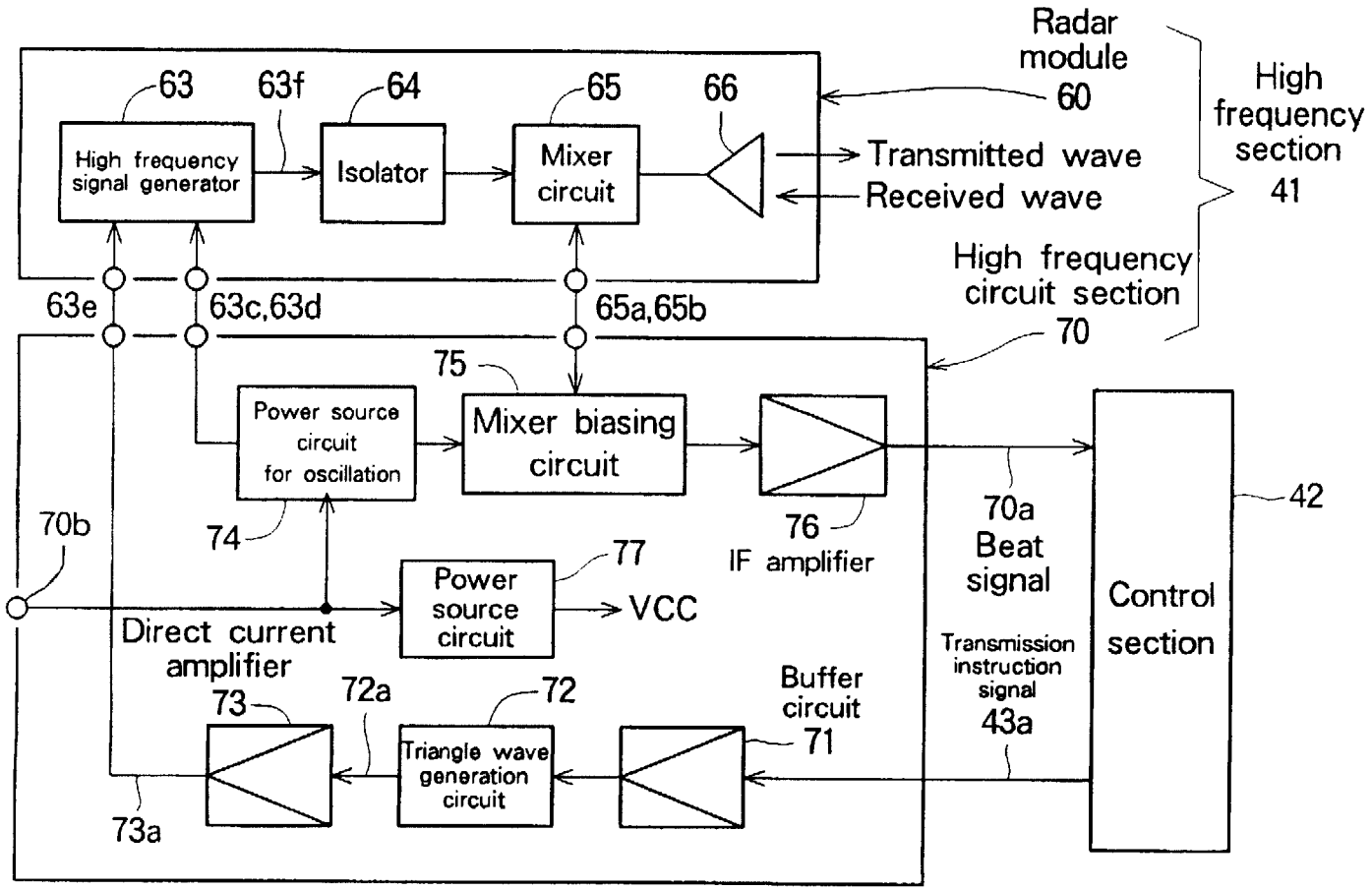
FIG. 8 is a block diagram illustrating the circuit structure of a high-frequency section.

FIG. 8 is a block diagram illustrating the circuit structure of the high-frequency section 41. High-frequency circuit section 70 provides various kinds of power sources to the radar module 60, and controls the transmitting operation of the radar module 60 on the basis of the transmission instructing signal 43*a* given from the control section 42 so as to output a beat signal 70*a*. The transmission instructing signal 43*a* is supplied via a buffer circuit 71 to a triangle-wave generation circuit 72, on the basis of which the generation circuit 72 generates a triangle wave signal 72*a* having a triangle-shaped voltage waveform. This triangle wave signal 72*a* is amplified in voltage by a D.C. amplifier 73 and then supplied to the high-frequency signal generator 63 of the radar module 60 as an oscillation-frequency designating voltage signal 73*a*.

The voltage-controlled oscillator 63*a* in the high-frequency signal generator 63 generates an FM signal 63*f* having a frequency designated by the oscillation-frequency instructing voltage signal 73*a*. The FM signal 63*f* is radiated as an electric wave via the dielectric rod antenna 66 after having been processed by the isolator 64 and mixer circuit 65. The power source circuit for oscillation 74 is constructed in such a manner to effect temperature compensation of the oscillation frequency by adjusting the power source voltage to be supplied to the high-frequency signal generator 63 depending on the ambient temperature. The power source circuit for oscillation 74 is also designed to supply a bias current to the Schottky barrier diode of the mixer circuit 65 via a mixer biasing circuit 75.

The mixer circuit 65 provides the Schottky barrier diode with the FM signal 63*f* supplied via the isolator 64 and a signal received by the dielectric rod antenna 66 (received signal), so as to mix the FM signal 63*f* and the received signal to thereby output a beat signal having a frequency corresponding to a difference between the frequencies of the FM modulation signal 63*f* and the received signal. The beat signal superposed with the bias current is extracted by the mixer biasing circuit 75, amplified by an IF amplifier (intermediate frequency amplifier) 76, and then supplied to the control section 42 as an ultimate received signal (beat signal) 70*a*.

The power source circuit 77 provides a stabilized power source VCC to the buffer circuit 71, triangle wave generator 72, D.C. amplifier 73 and IF amplifier 76. Reference numeral 70*b* denotes a power source input terminal.

Figure 9:
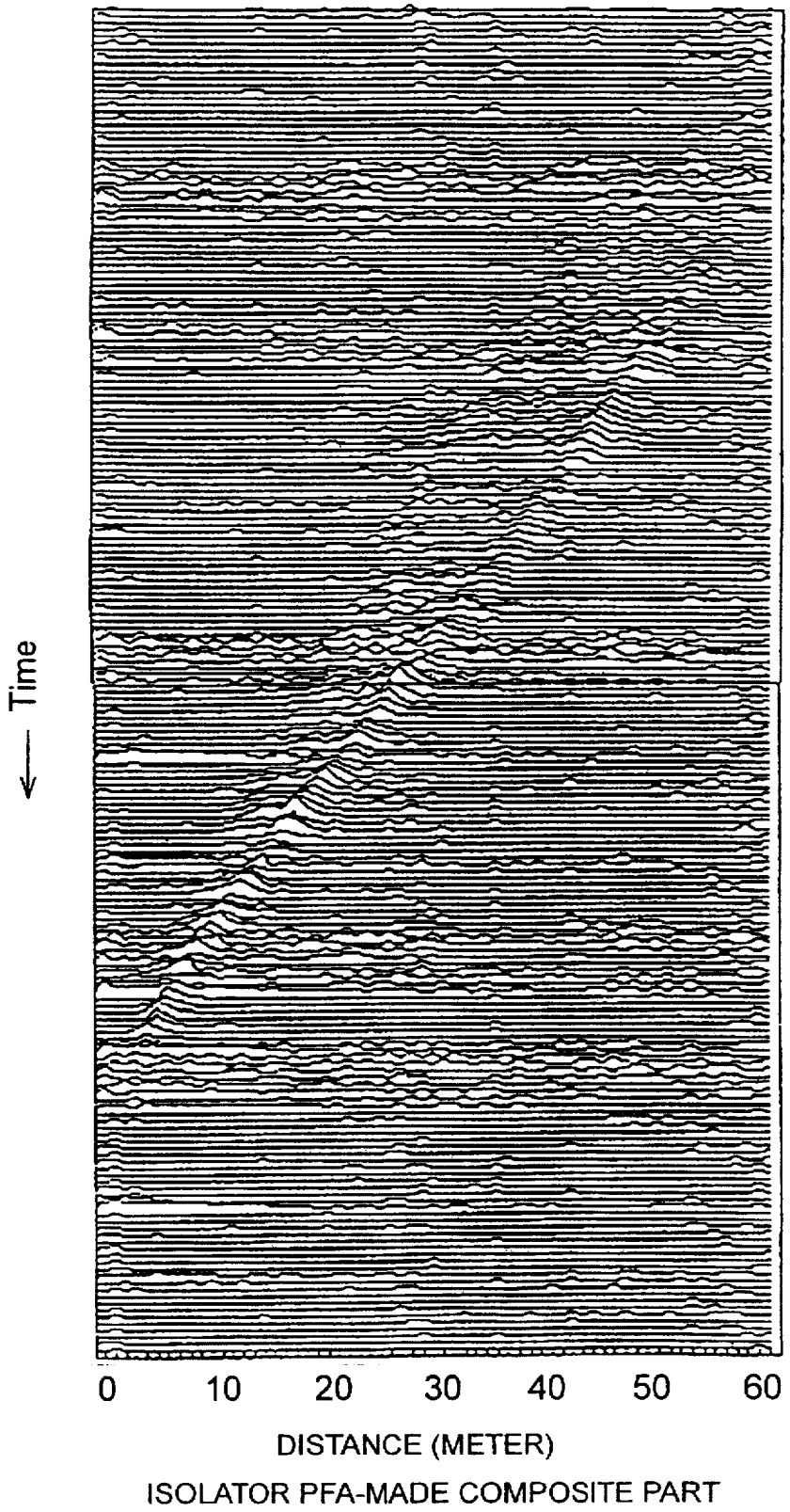
FIG. 9 is a graph showing changes in the frequency spectra of beat signals obtained by detecting an approaching automobile, in the case where the isolator is made by integrally molding a PFA material.
Figure 10:
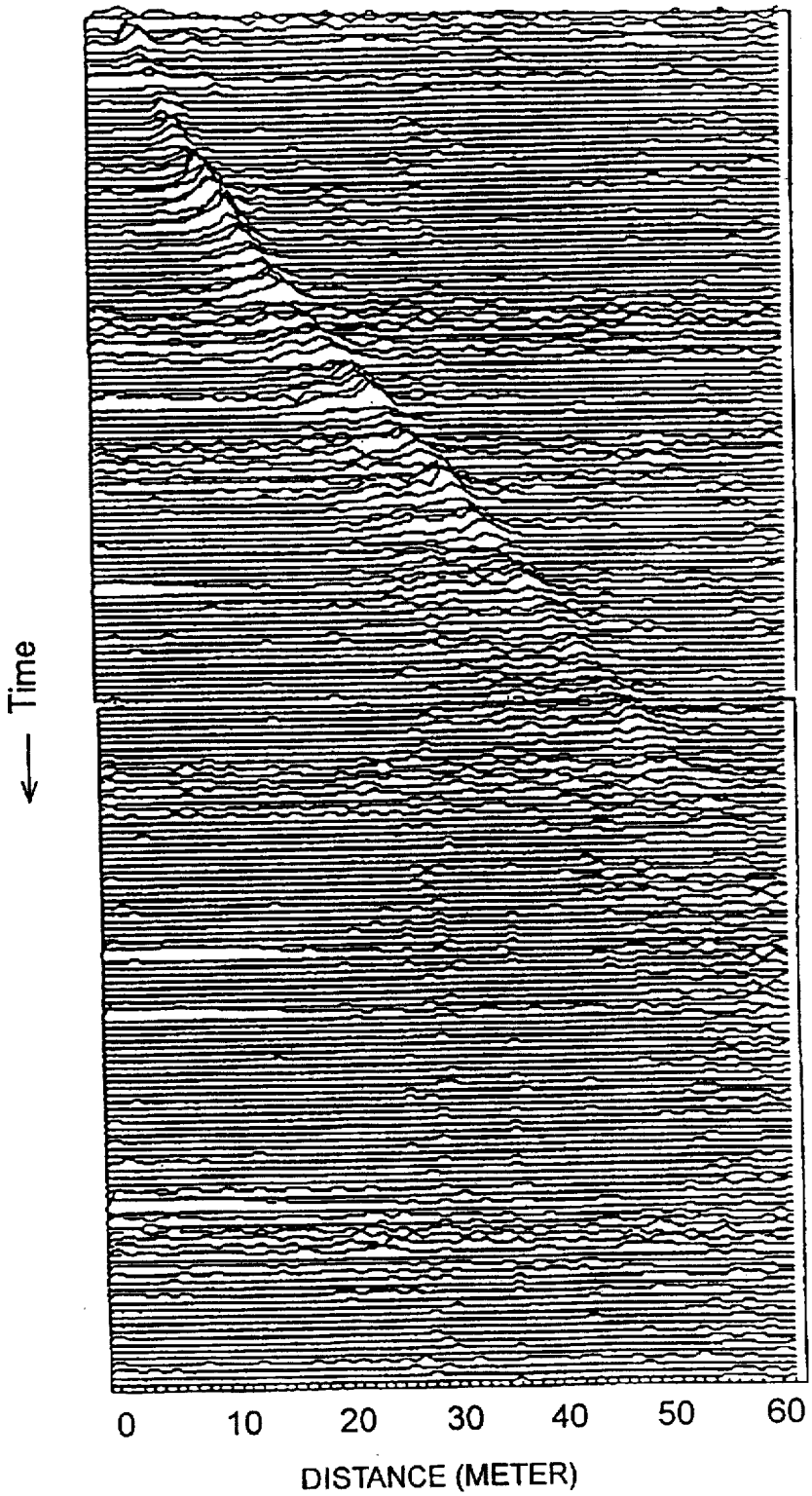
FIG. 10 is a graph showing changes in the frequency spectra of beat signals obtained by detecting of a going-away automobile, in the case of the isolator of FIG. 9.
Figure 11:
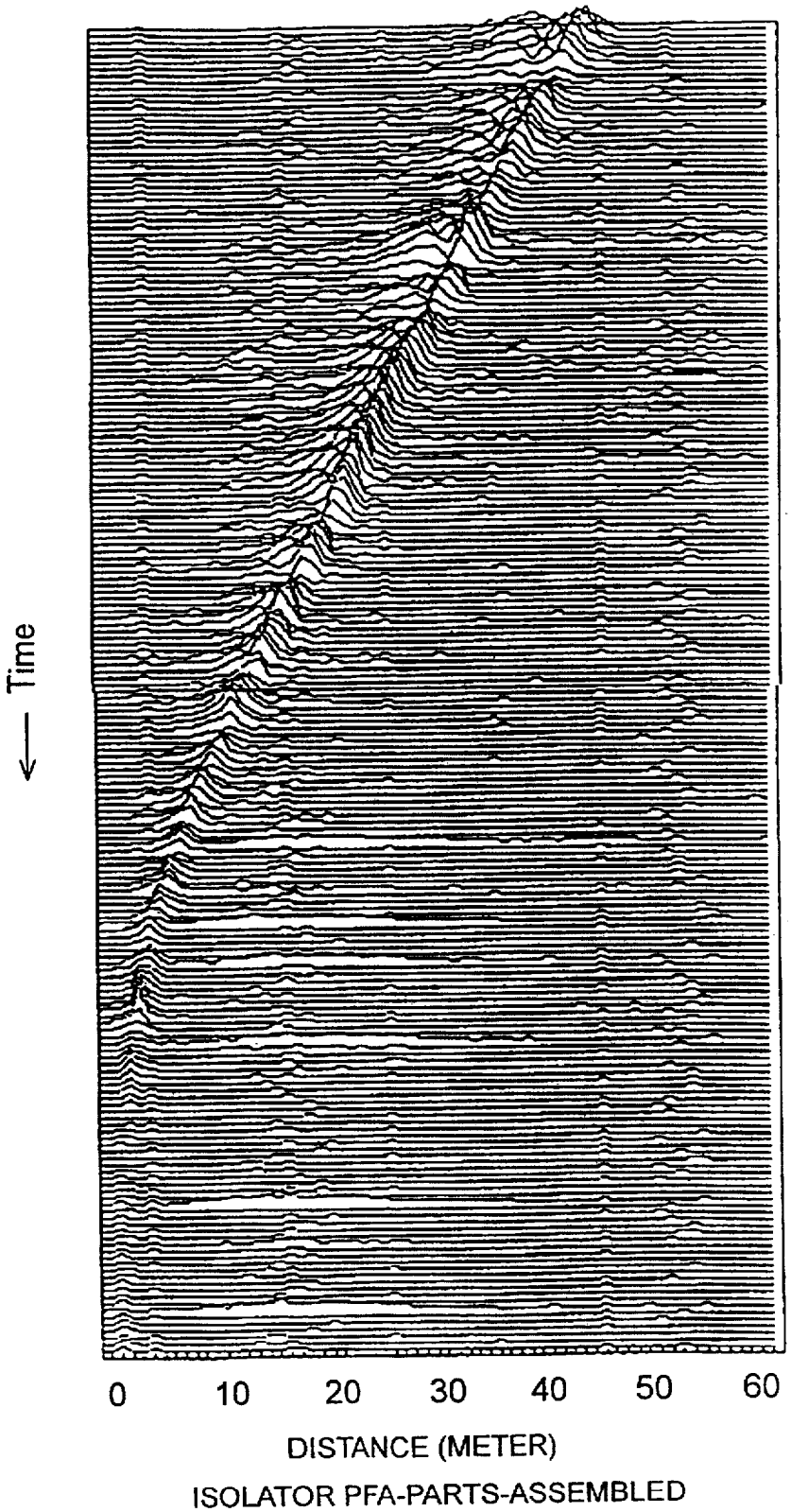
FIG. 11 is a graph showing changes in the frequency spectra of beat signals by detecting an approaching automobile, in the case where the isolator is an assembly of discrete component parts of PFA material.
Figure 12:
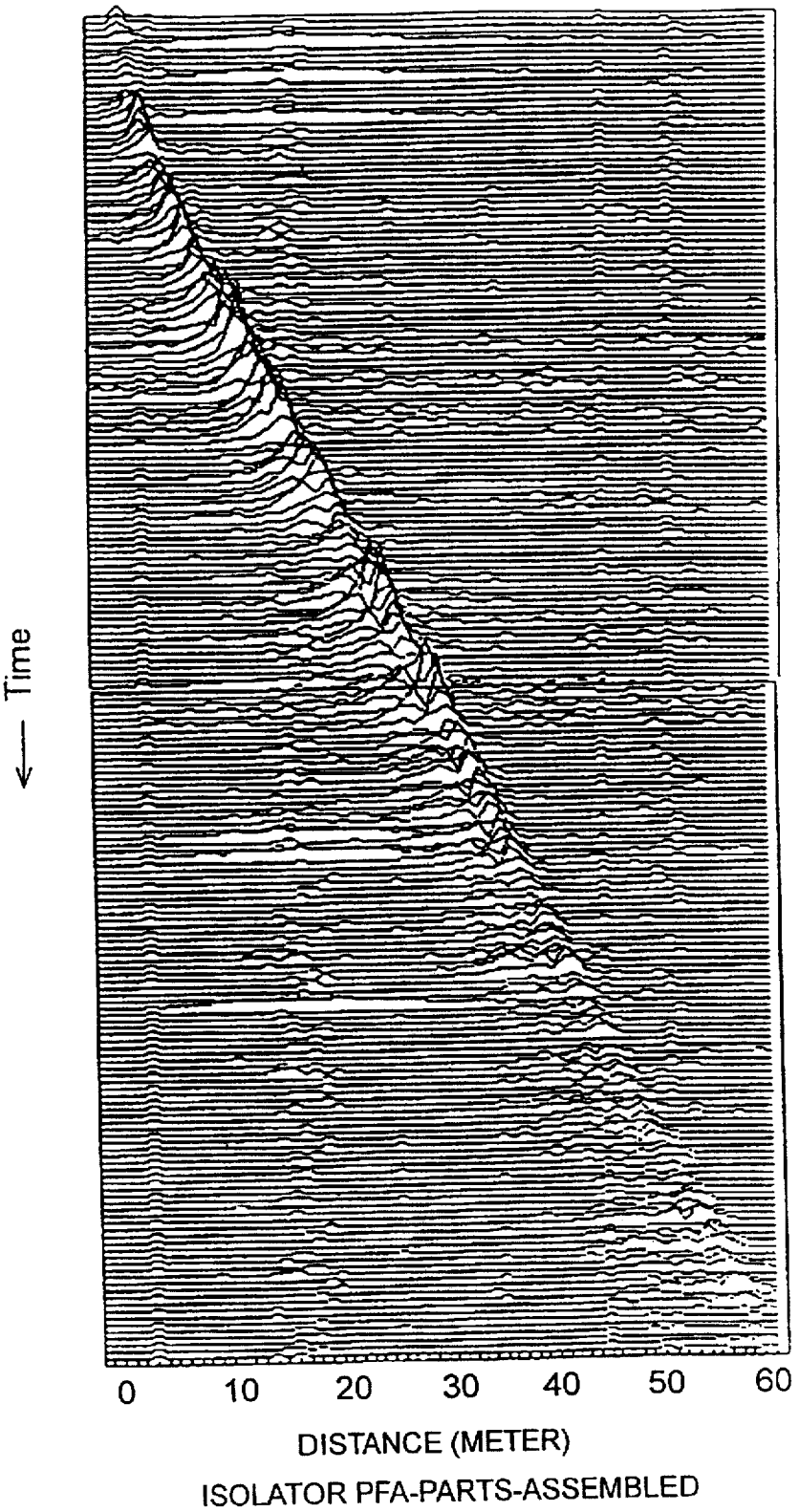
FIG. 12 is a graph showing changes in the frequency spectra of beat signals obtained by detecting a going-away automobile, in the case of the isolator of FIG. 11.
Figure 13:
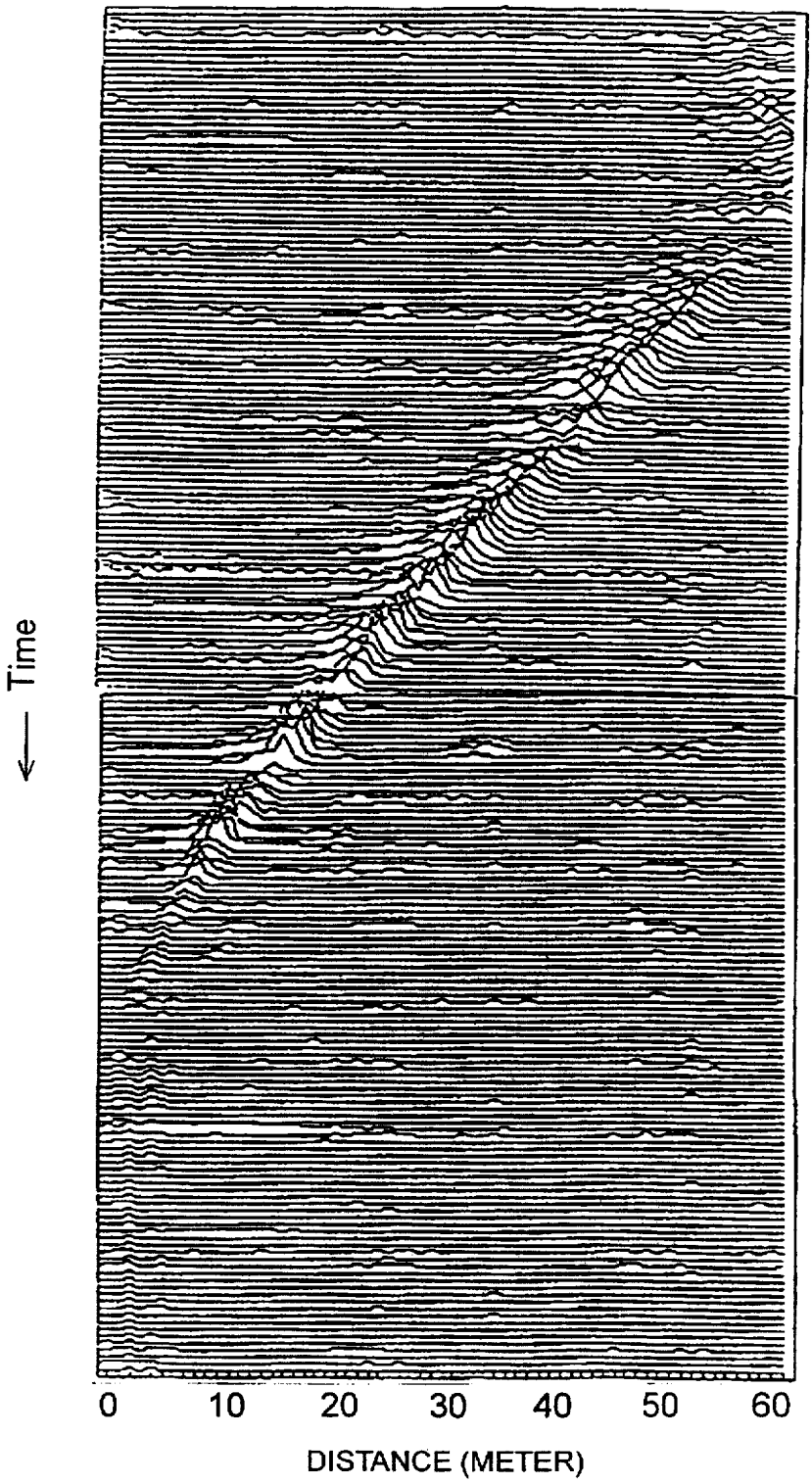
FIG. 13 is a graph showing changes in the frequency spectra of beat signals obtained by detecting an approaching automobile, in the case where the isolator is an assembly of component parts formed by cutting and processing PTFE resin.
Figure 14:
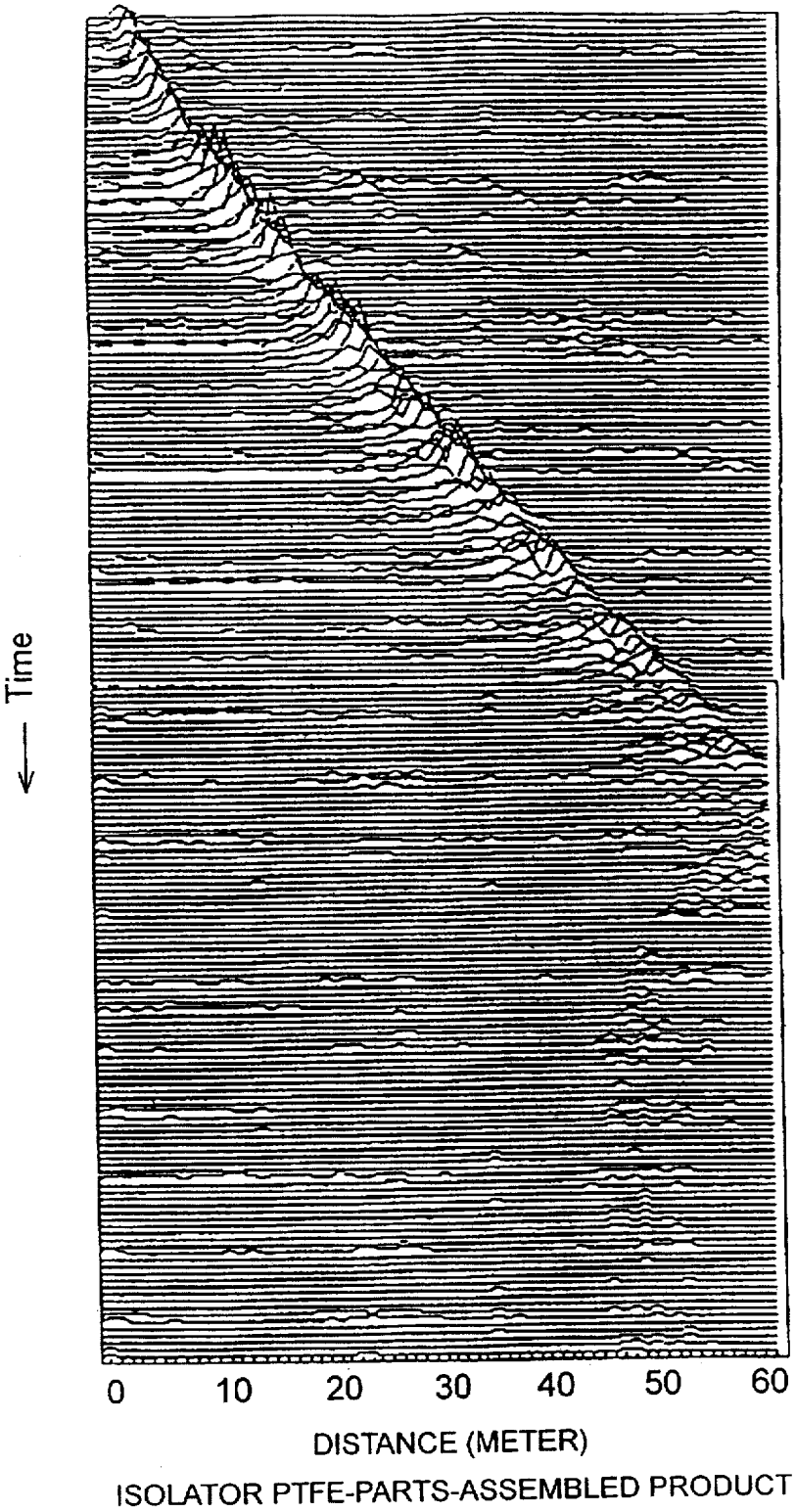
FIG. 14 is a graph showing changes in the frequency spectra of beat signals obtained by detecting a going-away automobile, in the case of the isolator of FIG. 13.
Figure 15A:
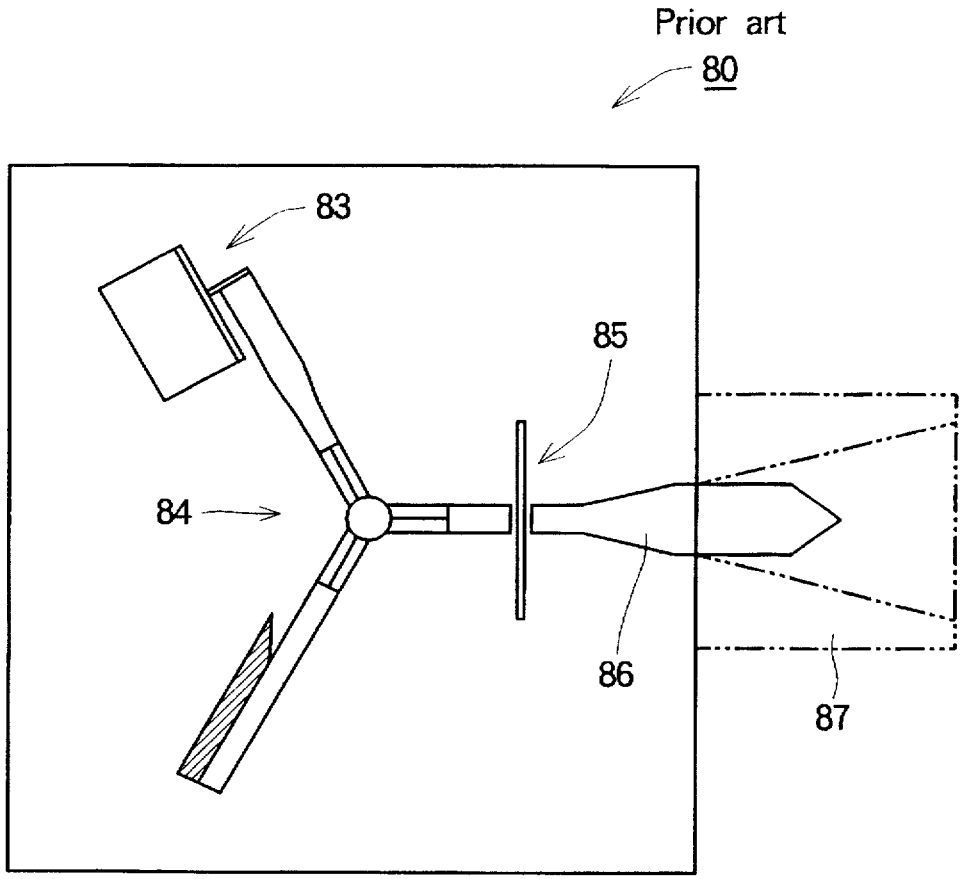
FIGS. 15A and 15B are plan and side views, respectively, of an FM radar module which employs a conventional NRD guide circuit.
Figure 15B:
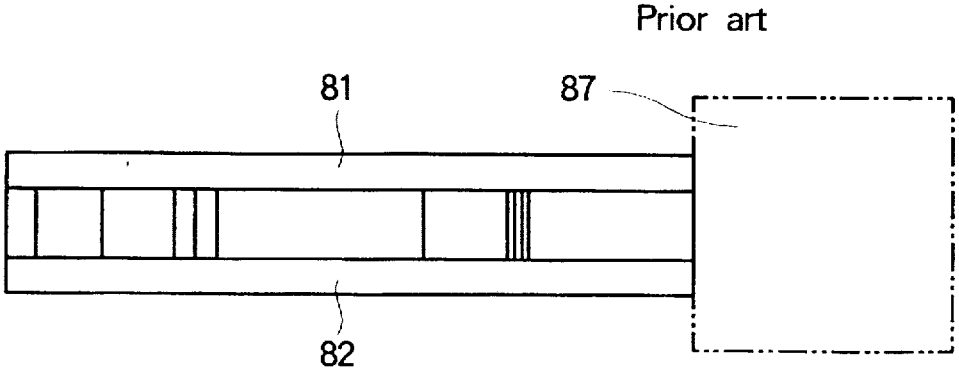
Figure 16:
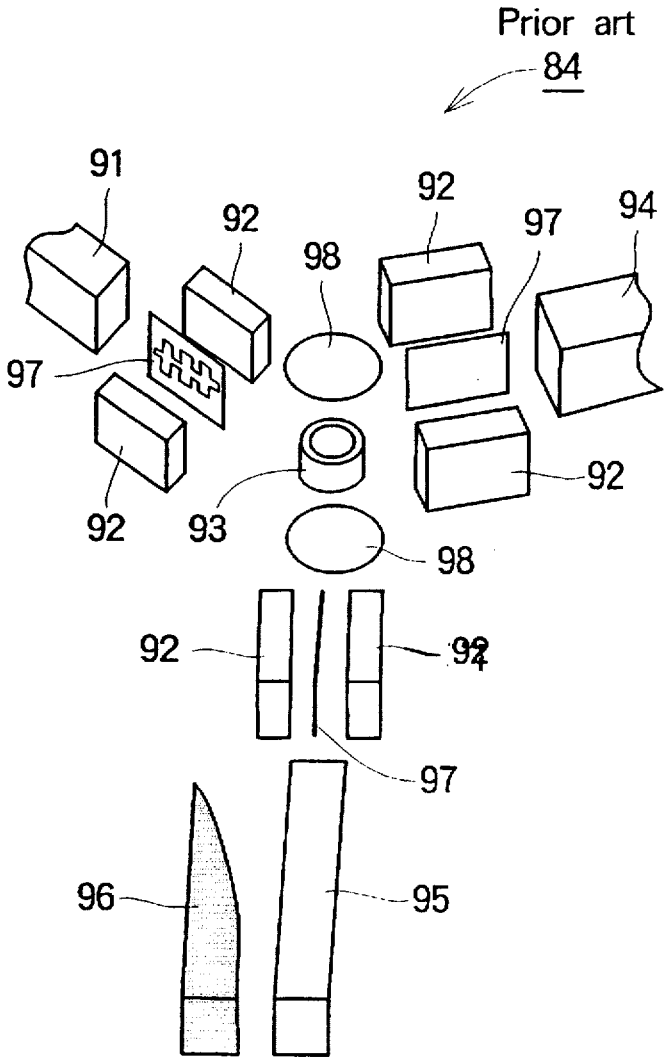
FIG. 16 is an exploded perspective view showing the structure of a conventional NRD guide isolator.

FIGS. 9, 11 and 13 are graphs each showing frequency spectral changes in beat signals obtained by detecting a car approaching the radar apparatus, while FIGS. 10, 12 and 14 are graphs each showing frequency spectral changes in beat signals obtained by detecting a car going away from the radar apparatus: FIGS. 9 and 10 show the spectral changes in the case where the isolator is composed of the PFA-molded composite part (integral-PFA-molded isolator); FIGS. 11 and 12 show the spectral changes in the case where the isolator is made as an assembly of discrete component parts of a PFA material (PFA-parts-assembled isolator); and FIGS. 13 and 14 show the spectral changes in the case where the isolator is made as an assembly of discrete component parts formed by cutting PTFE resin (PTFE-parts-assembled isolator). Each of the graphs of FIGS. 9 to 14 shows the frequency spectra of beat signals obtained at predetermined time intervals, with the vertical axis representing passage of time. Although the horizontal axis represents frequency, the graduations of the horizontal axis indicates distance in meters since the frequency of each beat signal corresponds to a distance to an object, i.e., another vehicle or car. Variations in the high-level portions (peak portions) in the frequency spectra show the other car approaching or going away from the radar apparatus (i.e., variations in the relative distance between the other car and the radar apparatus). In the case of the isolator composed of the integrally-molded composite part of a PFA material (integral-PFA-molded isolator), various possible objects (cars) within a range up to 50 meters can be detected although the peak portions are slightly lower.

With the above-described embodiment, the number of man-hours necessary for assembling the radar module 60 can be substantially reduced because a single integrally-formed composite part 10 of FIG. 1 can constitute the principal components of the radar module of FIG. 7. Further, because no gaps or positional shifts will occur in the integral composite part, there is enhanced reliability against mechanical vibration and thermal impact.

Although the embodiments have been described above in connection with the case where the NRD guide circulator and isolator are integrated, any other component parts than the circulator and isolator may be integrated as desired.

According to the NRD guide circuit of the present invention as described above, because the dielectric circuit component parts employed are molded from thermoplastic resin, the dielectric circuit component parts can be mass-produced with improved efficiency. Further, because no stress has previously been applied to the dielectric circuit component parts by a cutting process etc., stabilized characteristics of the dielectric circuit component parts are ensured. Where a material of relatively great dielectric constant is used, the line width of the dielectric circuit component parts must, as a rule, be designed to be narrow and hence the molding efficiency could be lowered; however, by use of a material having a dielectric constant not greater than 2.4, the component parts can be easily made into sizes suitable for mass-production. Further, by use of a fluorine-containing high polymer material, dielectric circuit component parts of high heat resistance can be obtained which, in the millimeter wave zone, presents a small loss tangent (tan δ) and small propagation loss in high-frequency signals. Moreover, the use of an injection-moldable fluoro high polymer material having a melting point not greater than 300° C. can substantially facilitate the injection molding. It was necessary, in the past, to previously apply thermal impact to component parts made by cutting or the like, in order to prevent line-forming parts from shrinking due to a repetition of abrupt temperature changes (which may result from, for example, changes in ambient temperature or from on/off operations of the oscillator employing a Gunn diode or the like); however, the injection molding of the fluorine-containing high polymer material as in the present invention can eliminate this necessity.

According to the NRD guide circuit of the present invention, the number of component parts to be assembled can be substantially reduced because a plurality of dielectric circuit component parts are integrated. Thus, the NRD guide circuit can be assembled with increased efficiency, and gaps or positional shifts between the parts will occur in fewer places. This can highly enhance the reliability of the NRD guide circuit and a functional module employing such an NRD guide circuit. Further, the use of injection molding allows complex-shaped component parts to be made with ease, and the use of a fluorine-containing high polymer material as a molding material can achieve a dielectric circuit composite part which has a high heat resistance and presents a small loss tangent (tan δ) and small propagation loss in high-frequency signals.

Further, in the NRD guide circuit of the present invention, plural dielectric circuit component parts are integrated into a single composite part so as to be used in common for two or more circuits. Thus, the composite part can be used universally for multiple purposes. Furthermore, in the NRD guide circuit of the present invention, the central ring portion and rod portions extending radially from the ring portion are integrally formed by injection molding so that the composite part may be suitably used in both an NRD guide circulator and NRD guide isolator. Thus, by use of such an NRD guide circuit, the circulator and isolator can be assembled with utmost ease.

Additionally, the use of the NRD guide circuit of the present invention permits a highly reliable radar module and radar apparatus to be made at reduced costs.

What is claimed is:

1. An NRD guide circuit comprising a pair of parallel, opposed conductive plates, and one or more dielectric circuit component parts held between said conductive plates, wherein said dielectric circuit component parts are molded from a thermoplastic resin material having a melting point not greater than 300° C., and wherein said thermoplastic resin material comprises an injection-moldable high polymer material containing fluorine, and said dielectric circuit component parts are injection-molded from said high polymer material.

2. An NRD guide circuit comprising a pair of parallel, opposed conductive plates, and one or more dielectric circuit component parts held between said conductive plates, wherein said dielectric circuit component parts are molded from a thermoplastic resin material having a melting point not greater than 300° C., and wherein a component part is made by integrally injection-molding a plurality of dielectric circuit component parts, and the component part is injection-molded from a high polymer material containing fluorine.

3. An NRD guide circuit as defined in claim 2 wherein said component part is made by integrating the dielectric circuit component parts so as to be used in common for two or more different circuits.

* * * * *